US008827008B2

(12) United States Patent
Hankins et al.

(10) Patent No.: US 8,827,008 B2
(45) Date of Patent: Sep. 9, 2014

(54) INFLATABLE RESTRAINT SYSTEM

(75) Inventors: John Benjamin Hankins, Cleveland, TX (US); Baldwin Zahn, Tomball, TX (US)

(73) Assignee: National Oilwell Varco, L.P., Houston, TX (US)

( * ) Notice: Subject to any disclaimer, the term of this patent is extended or adjusted under 35 U.S.C. 154(b) by 379 days.

(21) Appl. No.: 13/187,288

(22) Filed: Jul. 20, 2011

(65) Prior Publication Data

US 2012/0018222 A1 Jan. 26, 2012

Related U.S. Application Data

(60) Provisional application No. 61/366,121, filed on Jul. 20, 2010.

(51) Int. Cl.
*E21B 19/00* (2006.01)
*E21B 19/14* (2006.01)

(52) U.S. Cl.
CPC ..... *E21B 19/14* (2013.01)
USPC ..... 175/85; 175/52; 175/161; 414/22.51; 414/22.54

(58) Field of Classification Search
None
See application file for complete search history.

(56) References Cited

U.S. PATENT DOCUMENTS

| | | | | |
|---|---|---|---|---|
| 4,042,123 | A * | 8/1977 | Sheldon et al. | 414/22.71 |
| 4,725,179 | A * | 2/1988 | Woolslayer et al. | 414/22.65 |
| 4,932,537 | A | 6/1990 | Martinsen | |
| 5,246,394 | A * | 9/1993 | Jensen | 441/133 |
| 5,769,232 | A | 6/1998 | Cash et al. | |
| 6,976,540 | B2 | 12/2005 | Berry | |
| 6,997,265 | B2 | 2/2006 | Berry | |
| 7,083,007 | B2 | 8/2006 | Herst | |
| 7,510,028 | B2 * | 3/2009 | Welsh | 175/52 |
| 7,540,338 | B2 | 6/2009 | Belik | |
| 7,637,329 | B2 | 12/2009 | Stoik | |
| 7,736,119 | B2 | 6/2010 | Belik | |
| 2005/0092524 | A1 | 5/2005 | Herst | |
| 2007/0017704 | A1 | 1/2007 | Belik | |

(Continued)

FOREIGN PATENT DOCUMENTS

| | | | |
|---|---|---|---|
| NL | 8600679 | A | 10/1987 |
| WO | 2009049006 | A2 | 4/2009 |

(Continued)

OTHER PUBLICATIONS

PCT/US2011/044716 International Search Report and Written Opinion dated Jul. 30, 2012 (13 p.).
European Office Action dated Jun. 2, 2014; European Application No. 11739248.0 (4 p.).

*Primary Examiner* — Jennifer H Gay
*Assistant Examiner* — Caroline Butcher
(74) *Attorney, Agent, or Firm* — Conley Rose, P.C.

(57) ABSTRACT

A racking board for retaining tubulars is disclosed having a first finger, a second forger positioned generally parallel to the first finger and with a gap between the fingers serving as a storage area for tubulars. A first inflatable member is supported adjacent to the first finger and a second inflatable member is supported adjacent to the second finger, the inflatable members adapted to expand radially into the gap upon inflation so as to capture and retain the tubular. In some embodiments, a single inflatable member in employed to expand into the gap and retain the tubular. A method of racking tubulars is disclosed using elongate, inflatable restraints.

25 Claims, 9 Drawing Sheets

(56) References Cited

U.S. PATENT DOCUMENTS

| | | | |
|---|---|---|---|
| 2007/0221593 | A1 | 9/2007 | Apps |
| 2008/0164064 | A1 | 7/2008 | Belik et al. |
| 2010/0303586 | A1 | 12/2010 | Hankins et al. |

FOREIGN PATENT DOCUMENTS

| | | | |
|---|---|---|---|
| WO | 2010039811 | A2 | 4/2010 |
| WO | 2010041951 | A1 | 4/2010 |
| WO | 2011056711 | A2 | 5/2011 |

* cited by examiner

INFLATABLE RESTRAINT SYSTEM

CROSS-REFERENCE TO RELATED APPLICATIONS

This application claims benefit of U.S. provisional patent application Ser. No. 61/366,121 filed Jul. 20, 2010, and entitled "Inflatable Restraint System," which is hereby incorporated herein by reference in its entirety.

STATEMENT REGARDING FEDERALLY SPONSORED RESEARCH OR DEVELOPMENT

Not Applicable.

BACKGROUND

1. Field of the Invention

The present invention relates generally to methods and apparatus for handling and storing pipes and other elongated tubular members during well drilling, preparation, and maintenance. More specifically, the present invention relates to systems for holding, containing, storing, and restraining elongated tubular members in a controlled manner within a racking board, or fingerboard, or another structure.

2. Background of the Technology

Oil and gas well drilling systems employ numerous types of piping, referred to generally as "tubulars." Tubulars include, for example, drill pipes, casings, collars, and other elongate tubular members that are connectable end-to-end. Long "strings" of joined tubulars, or drill strings, are typically used to drill a wellbore and to prevent collapse of the wellbore after drilling. Segments of drill strings, such as individual sections of drill pipe or multiple sections of drill pipe that have been threaded together, are typically stored vertically on the drilling rig in a structure commonly referred to as a racking board. Racking boards (also known as a finger board) include a plurality of elongated support members or "fingers," the space between each pair of fingers capable of receiving multiple drill string segments. It is the upper end of a segment that is restrained by the racking board. The lower end of the segment rests on or near the drill floor.

In land rigs, the drill string segments are typically manually placed in the land rig racking board by an individual known as a derrick man, or sometimes by a remotely operated mechanical arm. As the segments are being added to or removed from the drill string, the derrick man maneuvers the top end of a segment into and out of a lifting device called an elevator. The drill string segments can vary in diameter depending on the type of well being drilled and the stage of the drill plan. While the segments are being stored in the racking board, their ends are typically tied back with rope so as to resist wind forces, vibration, and rig lean. Rigs which utilize a mechanical arm to rack the segments also require a means of securing them in the racking board. On larger offshore drilling units, with computerized control systems, this is typically accomplished with an individually controlled mechanical latches, one latch for restraining each drill string segment. This method and the control system to operate it are usually cost prohibitive in the land rig market so it is necessary to restrain the segments in the racking board without individually controlled latches. As mentioned, hand-tied ropes are commonly employed on land rigs, but this method is cumbersome. In addition, even where the rig includes an automated mechanical arm for use in the racking operation, there is a requirement on land rig applications to be able to return to manual racking quickly when the mechanical racking arm is out of service. Accordingly, a means for the timely disabling of any systems that would prevent manual racking is required. Conventional handling systems for drill string segments are described in U.S. Pat. Publication No. 20080164064 and U.S. Pat. Nos. 7,736,119 and 7,083,007, incorporated herein by reference in their entirety.

Accordingly, there remains a need for improved methods and apparatus for restraining tubular members within a racking board on a drilling rig while the tubulars are stored for subsequent use in forming the drill string.

BRIEF SUMMARY OF THE DISCLOSURE

Apparatus, systems and methods for restraining elongate members, such as drill pipe, are disclosed. In one embodiment, the apparatus includes a first finger, a second finger positioned generally parallel to the first finger and with a gap between the first and second fingers, the width of said gap being greater than the thickness of the elongate member. A first inflatable member is disposed adjacent the gap and is adapted to expand into said gap when inflated. The apparatus may be provided with a second inflatable member disposed adjacent the gap and also adapted to expand into the gap when inflated. The inflatable members, which may be adapted to be inflated with air or another gas, may be disposed on each side of the gap. The apparatus may also employ a gas system for inflating the inflatable members and causing them to radially expand. In some embodiments, the inflatable members are hose or other tubular segments, and may comprise externally reinforced hose portions with a rubber lining.

In another embodiment, a system and apparatus for restraining vertically-oriented, elongate members includes a support structure adapted for supporting a drill string above a well bore, a pair of arms coupled to the support structure and extending generally horizontally, a plurality of fingers extending from each of the arms with a gap defined between each pair of adjacent fingers, and elongate inflatable members coupled to the fingers, wherein the inflatable members are adapted to expand and extend into the gaps when inflated.

A method of restraining tubular members is disclosed including: supporting a plurality of spaced-apart elongate fingers at a height above a drill floor, the fingers arranged in pairs with a gap between each pair of fingers; supporting an elongate, expandable member adjacent at least one side of at least one gap, the expandable member adapted to expand radially into the gap upon inflation. The method further may include inflating the expandable member and, thereafter, positioning a tubular member in the gap in contact with the expandable member. Further, the method may include removing a tubular member from the gap while the expandable member is inflated.

Thus, embodiments described herein comprise a combination of features and advantages intended to address various shortcomings associated with certain prior devices, systems, and methods. The various features and characteristics described above, as well as others, will be readily apparent to those skilled in the art upon reading the following detailed description, and by referring to the accompanying drawings.

BRIEF DESCRIPTION OF THE DRAWINGS

For a detailed description of the exemplary disclosed embodiments of the invention, reference will now be made to the accompanying drawings in which.

DETAILED DESCRIPTION OF DISCLOSED EMBODIMENTS

Figure 1:
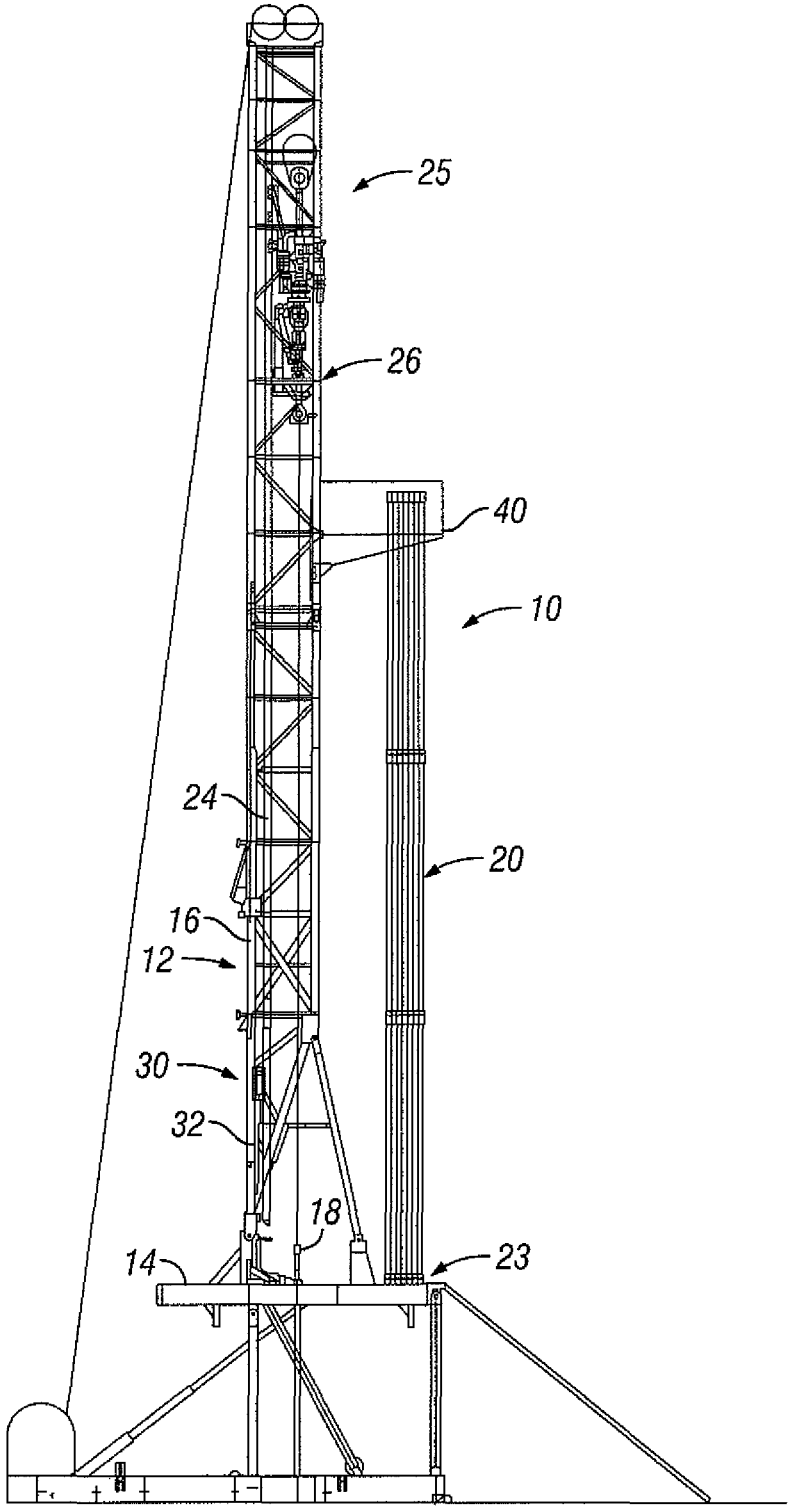
FIG. 1 is a schematic elevation view of a drilling system in accordance with various embodiments.

The following discussion is directed to various embodiments of the invention. The embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to limit the scope of the disclosure, including the claims to that embodiment.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct engagement of the two devices, or through an indirect connection, one made via other intermediate devices, components, and connections.

Certain terms are used throughout the following description and the claims to refer to particular features or components. As one skilled in the art will appreciate, different persons may refer to the same feature or component by different names. This document does not intend to distinguish between components or features that differ in name but not function. The use of the term "pipe" or "drill pipe" herein will be used to describe and include any tubular member, including casings, drill collars, pipes, stands of drill pipe, etc. Further, the term "pipe segment" will be used in some situations to describe and include one discrete (individual) tubular member, and in other situations the term will be used to describe and include more than one discrete tubular member coupled together. Thus, for example, three sections of drill pipe that are threaded together to form a "stand" falls within the definition of "pipe segment." The drawing figures are not necessarily to scale. Certain features and components herein may be shown exaggerated in scale or in somewhat schematic form, and some details of conventional elements may not be shown in interest of clarity and conciseness.

Embodiments of the present invention include methods and apparatus for restraining vertically-oriented, elongate pipe segments of varying diameters in a fingerboard or racking board on a drilling rig, one where the need for an individual restraint for each individual pipe segment is unnecessary.

Referring initially to FIG. 1, a drilling system 10 includes a rig structure 12 having a drill floor 14 and a mast or derrick 16. Vertically-extending derrick 16, combined with supporting features, is designed to act as a support structure for supporting a drill string suspended within a borehole along the well centerline. A drill string 18 extends through the drill floor 14. Several vertically-oriented members, e.g. pipe segments 20, are set back from the drill string on the drill floor 14 in a storage area 23, waiting to be added to the drill string 18. Storage area 23 extends vertically upward to encompass the three-dimensional space needed to house the pipe segments 20. A racking board 40 is coupled to derrick 16 and is suspended horizontally above drill floor 14 and is positioned to retain and store the ends of pipe segments 20. In exemplary embodiments, pipe segment 20 includes three individual pipe segments coupled together into a "stand" of drill pipe. In other exemplary embodiments, pipe segment 20 includes one or more individual, unconnected pipe segments. Drill floor 14 may support other pipe handling systems for the drilling or tripping process, such as a stabbing system, slips, a pipe lubricator, a mud bucket and other systems (not shown) used in making up or breaking out pipe joints.

The upper portion of the derrick 16 supports a lifting and support mechanism, such as a top drive system 25 including a pipe elevator 26. A torque tube 24 or other support structure extends downward from the top drive system 25. A pipe handling system (not shown) may be provided to engage a pipe segment and control lateral movement of the pipe segment as it is moved between a storage position and a well center position. The pipe guide system may be robotic, meaning automated or remotely operated. During some operations, a worker located on or near racking board 40 may manually control lateral movement of the pipe segment as it is moved between a storage position and a well center position.

Figure 2:
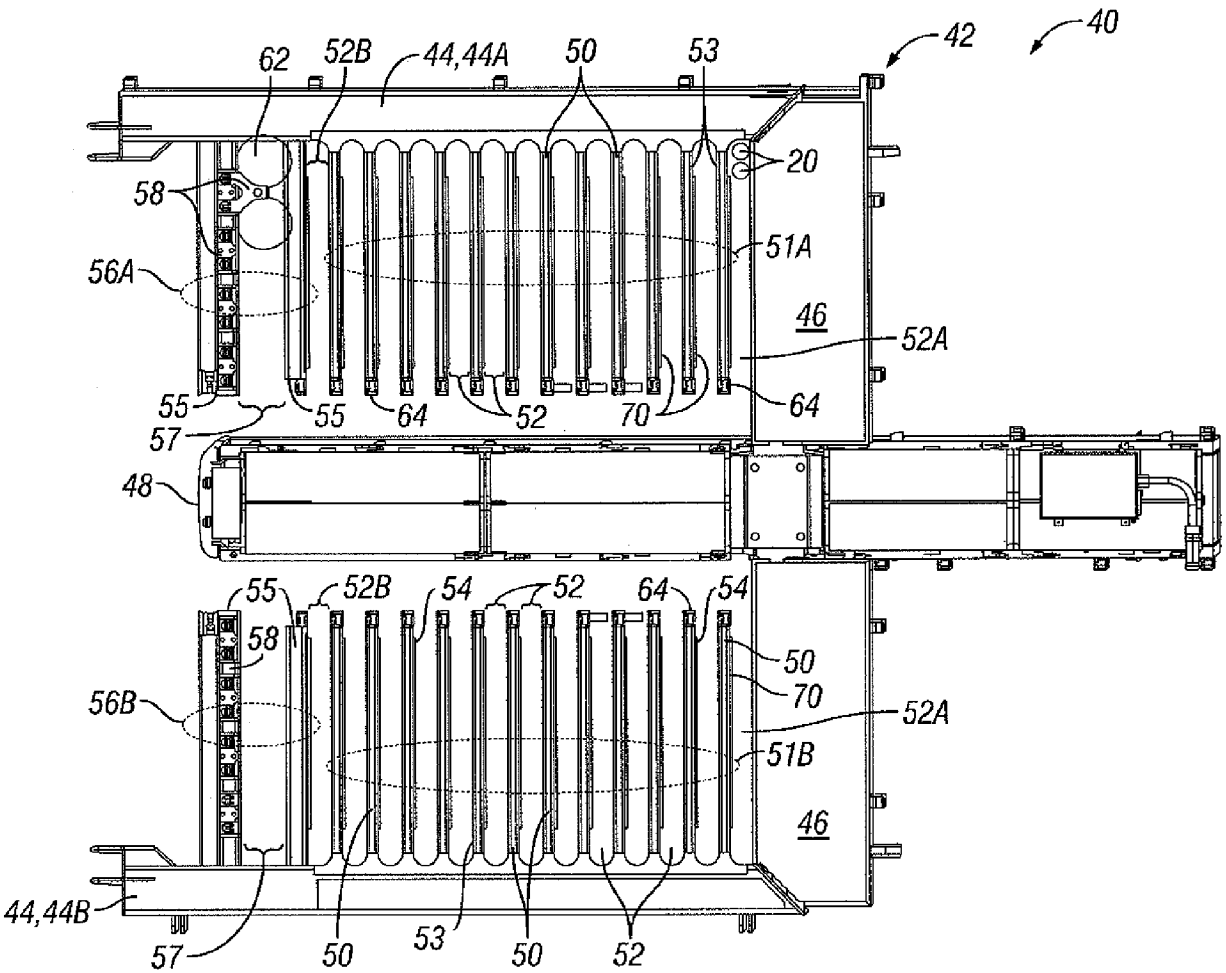
FIG. 2 is a top plan view of a racking board system in accordance with principles described herein.
Figure 3:
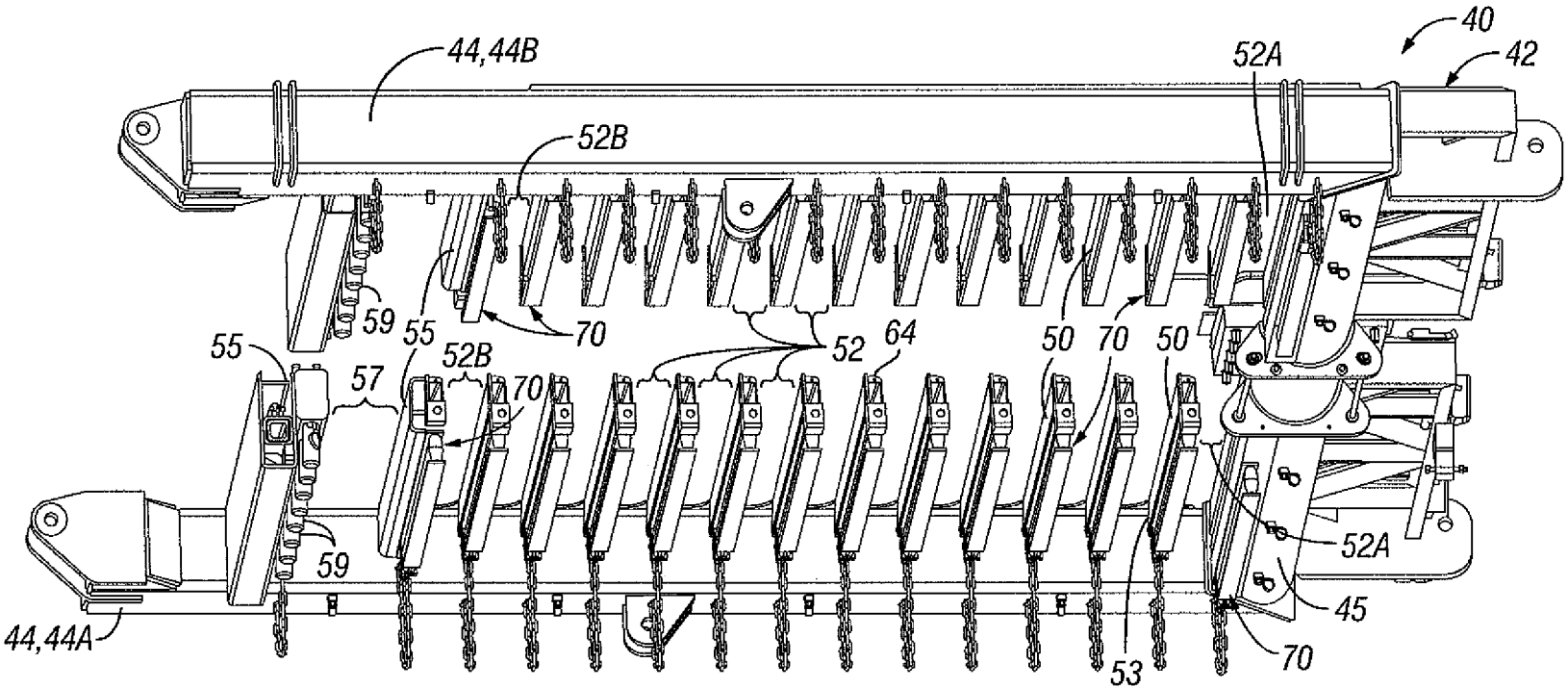
FIG. 3 is a bottom perspective view of a portion of the racking board system of FIG. 2.

FIG. 2 presents a top view of an embodiment of a racking board 40, also referred to as a fingerboard. FIG. 3 gives a perspective view of racking board 40 looking up from the bottom. In FIG. 3 some components are not shown for clarity. Referring then to FIGS. 2 and 3, racking board 40 comprises an outside cage 42, a central, rectangular structure called a diving board 48, a plurality of elongate sectional dividers, called fingers 50, and, in this embodiment, further includes one or more heavy-duty or robust fingers 55. The outside cage 42 has a generally rectangular shape with one end open. Two opposing side arms 44 extend away from a connecting beam 45, which is visible in FIG. 3. A plate 46 (FIG. 2) covers connecting beam 45 and other support structure. In the embodiment shown, side arms 44 comprise rigid tubular members of generally square cross-section, and connecting beam 45 comprises a rigid member having a circular cross-section; however, arms 44 and beam 45 may take other suitable shapes and configurations.

As shown in FIG. 2, racking board 40 includes several elongate fingers 50, formed from tubular metal with a generally rectangular cross-section, and in this embodiment, includes four elongate heavy-duty fingers 55. Each finger 50 comprises a fixed end 53 that is coupled to a side arm 44 and a free end 54 that is not attached to side arm 44 or another support structure. Heavy-duty fingers 55 comprise similar fixed ends and free ends (not designated).

A first group 51A of generally parallel fingers 50 and a first group 56A of generally parallel heavy-duty fingers 55 are attached to the inner edge of a first side arm 44A and extend generally horizontally and generally perpendicular to side arm 44A. A second opposing group 51B of generally parallel fingers 50 and a second opposing group 56B of generally parallel heavy-duty fingers 55 are attached in a generally horizontal orientation to the inner edge of the second side arm 44B and are generally perpendicular to the side arm 44B. In this way, the opposing group 51B of fingers 50 extends from side arm 44B toward the first group 51A of fingers 50 attached to side arm 44A. In the same way, the opposing group 56B of heavy-duty fingers 55 extends toward the first group 56A of heavy-duty fingers 55. Heavy-duty fingers 55 are disposed at a distance further from connecting beam 45 as compared to fingers 50, which are closer to connecting beam 45.

Referring to FIG. 2, in between each pair of adjacent fingers 50, a gap or slot is formed. The gap is a storage space 52 to hold, or restrain, an end of pipe segments 20, as exemplified in the upper corner of FIG. 2 and shown more generally in FIG. 1. For clarity, only two pipe segments 20 are shown in FIG. 2, however, it is to be understood that, in use, many additional pipe segments 20 may be retained in racking board 40. The distance between adjacent fingers 50 defines the width of the storage space 52 and is sized so as to provide a gap large enough to accommodate pipe segments having predetermined diameters "D," as explained below. The free end 54 of finger 50 may be coupled to a bracket 64 to receive a finger latch 170 that closes the entrance to storage space 52. For clarity and for ease in depicting other components, only a few, representative finger latches 170 are depicted in FIG. 2, it being understood that finger latches 170 may be employed to close the entrance to many or all of storage spaces 52. In between each pair of adjacent, heavy-duty fingers 55, a larger gap is formed. The larger gap is larger storage space 57 to contain larger diameter tubular members such as drill collars 62. One or more collar clamps 58 may be disposed along a heavy-duty finger 55 to restrain one or more of the drill collars 62 or other large diameter tubular members when present.

Best seen in FIG. 3, actuators 59 drive the motion of collar clamps 58 (FIG. 2). Additional storage spaces 52A are formed between the connecting beam 45 and the two most proximal fingers 50. Further storage spaces 52B are also formed between the most distal fingers 50 and the adjacent heavy-duty finger 55. Throughout the document, references to storage space 52 is to be interpreted broadly to include storage spaces 52A, 52B, unless specifically stated to the contrary.

Referring again to FIG. 2, diving board 48 is centrally disposed between the opposing groups 51A, 51B of fingers 50 and between the opposing groups 56A, 56B of heavy-duty fingers 55, which extend toward one another but do not touch. Diving board 48 is coupled generally at the center of connecting beam 45, and extends in one or both directions from connecting beam 45. Diving board 48 is equally spaced between, and extends parallel, to the two side arms 44A, 44B. Diving board 48 includes a support structure and an upper plate upon which an operator or derrick man can walk. Diving board 48 may also support an automated or remotely operated, movable pipe handling arm (not shown) to grip and move pipe segments 20 to and from the storage spaces 52, 57.

Figure 4:
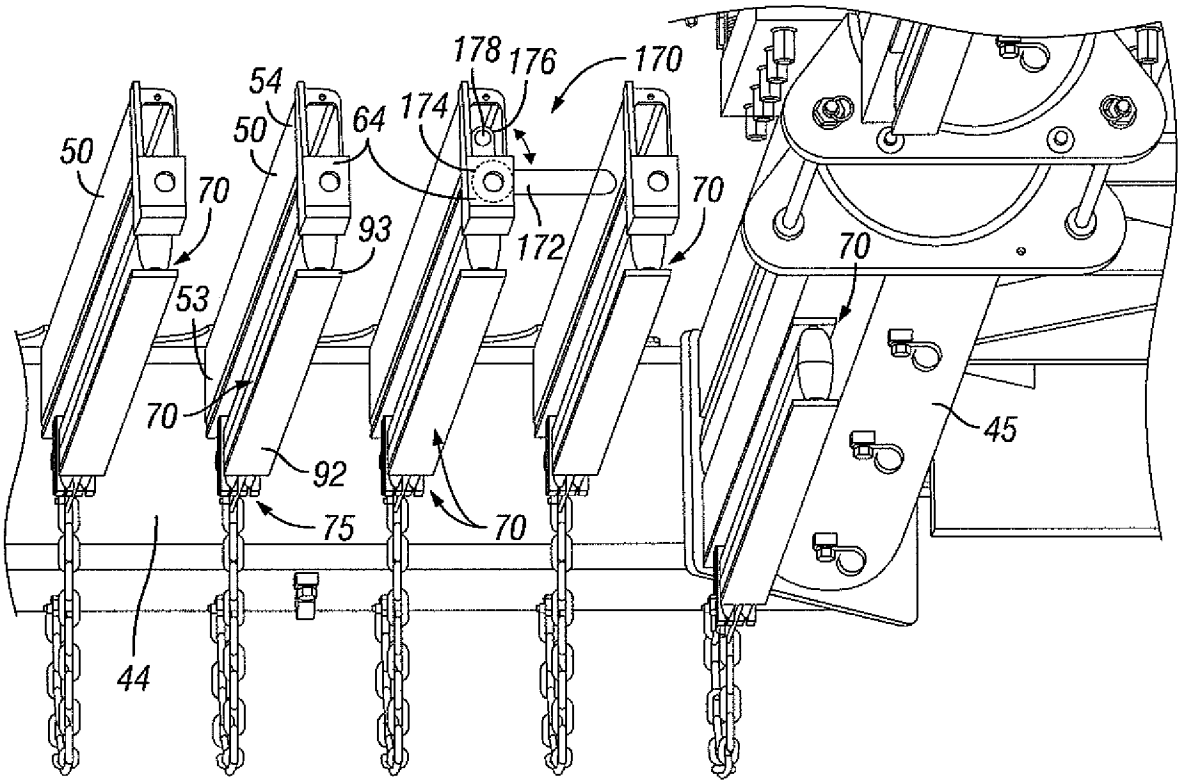
FIG. 4 is an enlarged, bottom perspective view of the racking board system of FIG. 3.

As seen in FIG. 3 and more clearly in the closer view of FIG. 4, an embodiment of an inflatable restraint system, including inflatable restraint 70, is coupled to at least one finger 50. Inflatable restraint 70 is provided to apply pressure against one or more vertically disposed pipe segments 20 that are disposed in a storage area 52 and oriented generally perpendicularly to the fingers 50 (FIG. 2). In the disclosed embodiment, inflatable restraint 70 is disposed underneath finger 50. However, in other embodiments, appropriately configured inflatable restraints could be built and installed in other positions adjacent finger 50 based on the concepts taught in this disclosure. As shown, in this embodiment, other inflatable restraints 70 are coupled to connecting beam 45 and to a heavy-duty finger 55 (FIG. 3). In FIGS. 3 and 4, restraints 70 are depicted in a deflated or unexpanded state.

Figure 10:
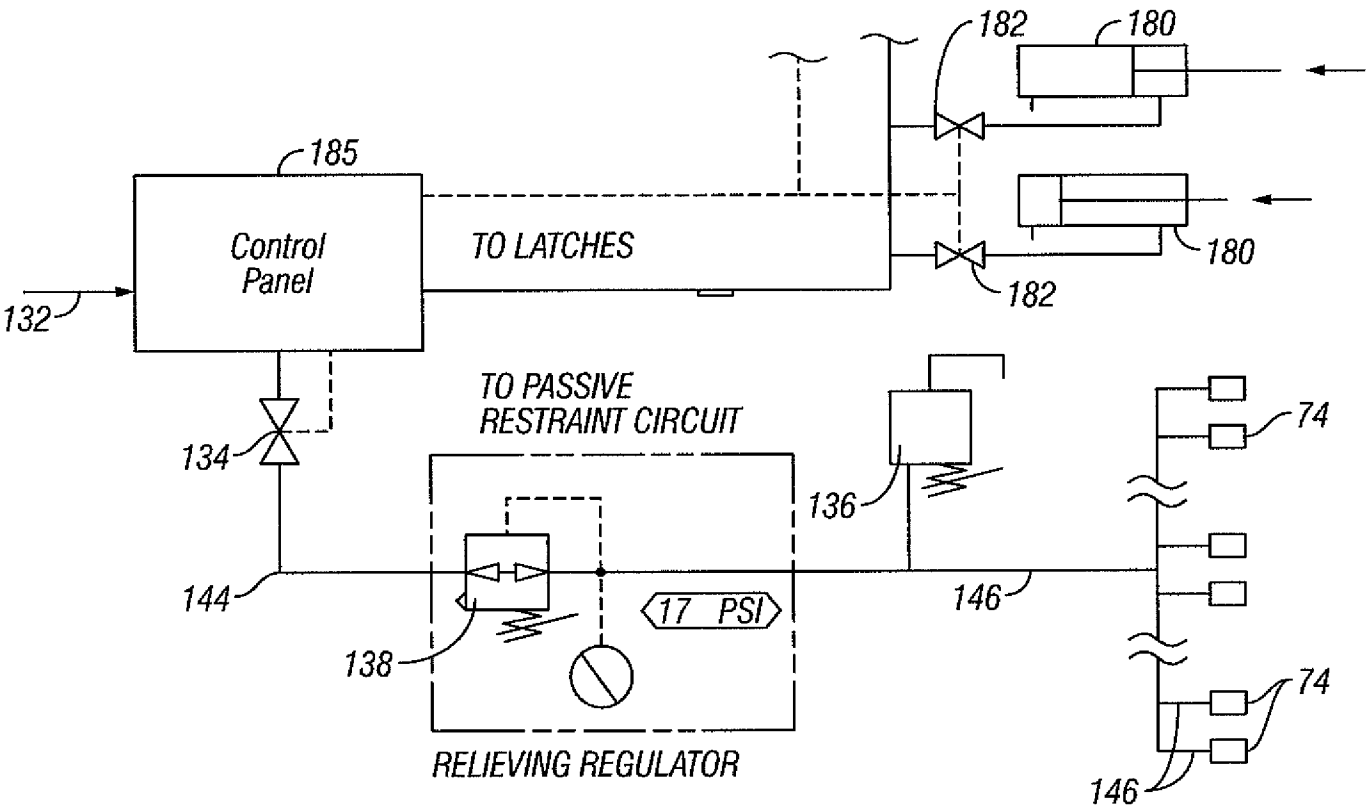
FIG. 10 is a schematic diagram of the pneumatic supply piping for a racking board system of with inflatable restraints, in accordance with various embodiments.

FIG. 4 presents one representative finger latch 170 mounted in a bracket 64. As explained with reference to FIG. 2, brackets 64 are not all depicted having a finger latch installed. Finger latch 170 acts as a secondary retainer for pipe segments 20 that are held within a storage space 52 by inflatable restraints 70. Finger latch 170 comprises a latch arm 172, a cylindrical shaft 174, a cable 176, pulley 178, an internal torsion spring (not shown), and a guides cable into finger 50 to be actuated by a pneumatic cylinder 180 (FIG. 10). Cylindrical shaft 174 couples rotationally with bracket 64 that is attached to free end 54 of finger 50 or a free end of a heavy-duty finger 55. Latch arm 172 is contiguous with cylindrical shaft 174 and, in a common configuration, extends vertically across the end of storage space 52. The torsion spring couples between shaft 174 and bracket 64. Pulley 176 is mounted vertically inside of finger 50, 55 at free end 54. Cable 176 wraps around the surface of shaft 174 and passes around pulley 178 and into the hollow center of finger 50, 55. (The wrapping around shaft 174 is not shown.) Inside finger 50, 55, cable 176 attaches to pneumatic cylinder 180. The pneumatic cylinder 180 is configured to provide tension on cable 176 when compresses gas pressure is supplied by a control valve 182, which is governed by racking board control panel 185. Tension on cable 176 rotates shaft 174, thereby raising latch arm 172 and opening the end of storage space 52. As mentioned above, the reference to storage space 52 also refers broadly to include storage spaces 52A, 52B. When the compresses gas pressure is release from cylinder 180, the torsion spring rotates shaft 174, causing arm 172 to extend across the end of end of storage space 52. So finger latch 170 is configured to be normally closed and to require actuation to open.

Figure 5:
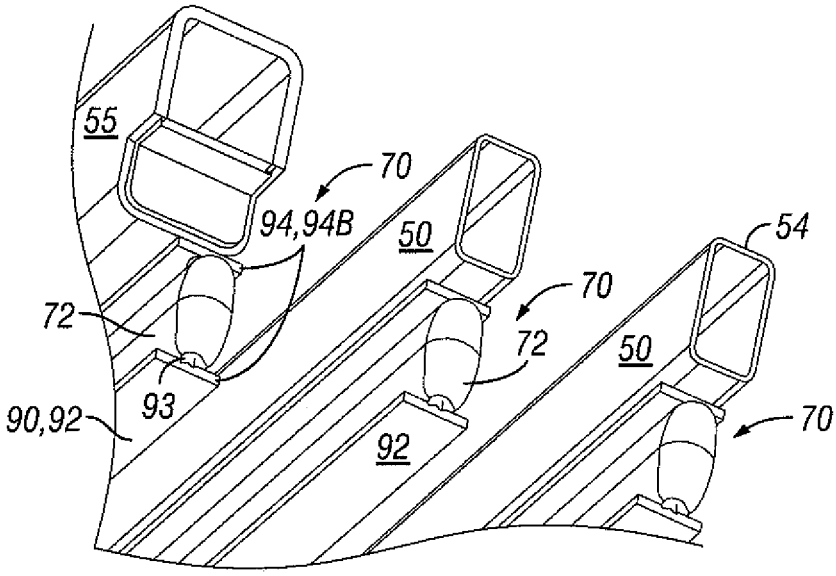
FIG. 5 is an enlarged, bottom perspective view showing an end portion of several inflatable restraints of the racking board system of FIG. 3.
Figure 6:
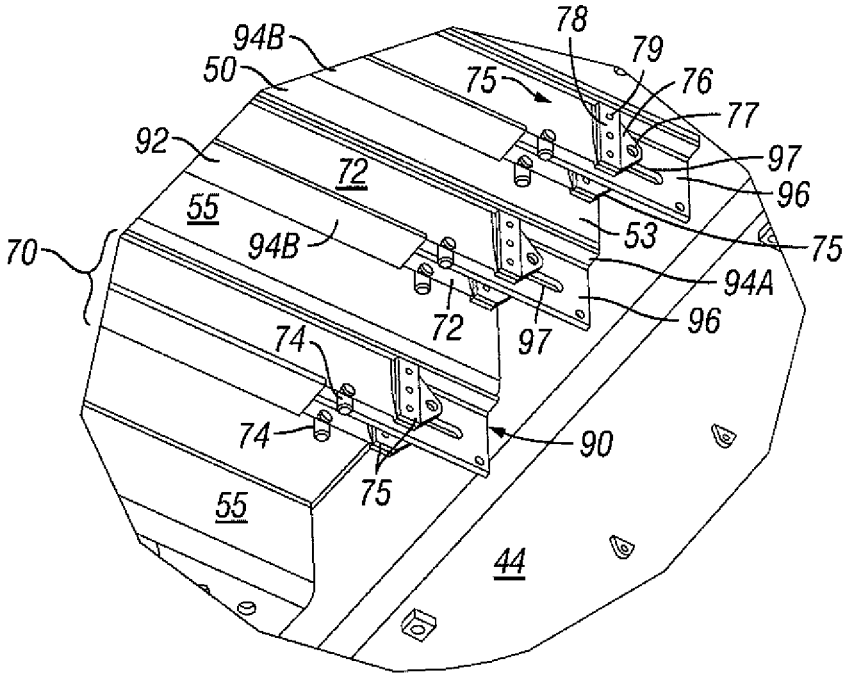
FIG. 6 is an enlarged, bottom perspective view showing the end portions of inflatable restraints including clamps in accordance with FIG. 3.

Referring now to FIGS. 5 and 6, inflatable restraint 70 comprises a support structure 90 and at least one radially expandable tubular member, such as inflatable bladder or hose 72. The radially expandable tubular member can be made of any suitable material. For example, bladder or hose 72 may be formed from a flexible, expandable, and collapsible, externally-reinforced, hermetically-sealable hose. As used herein, the term "hermetically-sealable" means that the interior of the bladder or hose is sealed against the unintended exchange of liquids and gaseous substances. For example, hose 72 may include mill hose or conventional jacketed fire hose and may be rubber-lined. The selected material may be cut into tubular segments or portions, and adapted for inflation by injection of a compressed gas such as air or nitrogen.

FIG. 5 shows a bottom perspective view of a portion of the free (unsupported) ends 54 of two fingers 50 and one heavy-duty finger 55, each shown coupled with a separate inflatable restraint 70. FIG. 6 presents the opposite, fixed ends 53 of multiple fingers 50 along with the accompanying inflatable restraints 70, all coupled to a side arm 44.

Referring still to FIGS. 5 and 6, support structure 90 comprises an elongated rigid member, I-beam 92. I-beam 92 includes a central component, web 93, and two flanges 94 extending perpendicular to web 93 disposed at opposite ends of web 93. With web 93 vertically-oriented, the upper flange 94A couples to the lower surface of finger 50, heavy-duty finger 55, or connecting beam 45, depending on where the inflatable restraint 70 is installed. When installed on a finger 50, one end of I-beam 92 is disposed near the free end 54. I-beam 92 extends with finger 50 to a side arm 44, which is a portion of outside cage 42. When an I-beam 92 is attached to heavy-duty finger 55 or to connecting beam 45, a similar arrangement is employed.

As best seen in FIG. 6, a section of I-beam 92 nearest sidearm 44 does not include lower flange 94*b*. This portion of I-beam 92 is referred to herein as modified end 96. An elongated, slot 97 is cut horizontally in the vertical middle of web 93 at modified end 96. Slot 97 passes through the entire thickness of web 93.

Again referring to FIGS. 5 and 6, a length of expandable hose 72 is sealed at both ends and includes one or more communication ports 74 for pressurized air. Expandable hose 72 extends from modified end 93 of I-beam 92, and passes down along one side of I-beam 92 adjacent to web 93 in the space between the lower flange 94B and upper flange 94A. Hose 72 wraps 180 degrees around the unmodified end of I-beam 92 (the end opposite the modified end 96) and continues back along the other side of web 93 until reaching the other side of the modified end 96. Air communication ports 74 are provided at each end of hose 72. Ports 74 extend downward at modified end 96 at the location where the lower flange 94*b* is not present.

In the disclosed embodiment of FIGS. 5, 6, clamp 75 provides both a method for sealing and a method for attaching hose 72 to fingers 50. A clamp 75 is disposed at each end of hose 72 and comprises a triangular-shaped, bracket member 76, and an opposing rectangular bracket member 78. The end of hose 72 is flattened and held between these two members 76, 78. Through-holes 79 pass through both members 76, 78 and simultaneously through the end of hose 72 to join them with fasteners and to seal hose 72 via compression provided by brackets 76, 78. Triangular member 76 has an additional mounting hole 77 to receive a fastener (not shown) that passes through and slidably engages slot 97 in I-beam 92. Because both ends of hose 72 have a clamp 75, and the two clamps 75 are disposed on opposite sides of modified end 96 of I-beam 92, the fastener that passes through mounting hole 77 on one clamp 75 and slot 97 is also disposed through mounting hole 77 on the other clamp 75. This fastening arrangement allows the fastener in holes 77 to be loosened and slid along slot 97 in modified end 96 to pull hose 72 tighter or to loosen hose 72, after which the fastener is tightened to grip clamps 75 and rigid member 96. When hose 72 is attached and air or other gas is injected into hose 72 via air communication ports 74, the hose 72 inflates and expands radially.

Figure 7:
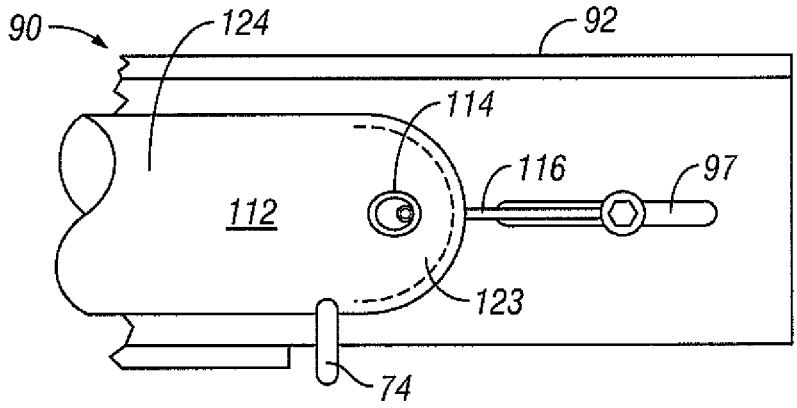
FIG. 7 is a cut-away view of another inflatable restraint system in accordance with principles described herein.

The cut-away view of FIG. 7 presents a second embodiment of an inflatable restraint 70 having a radially expandable tubular member. In this embodiment, at least one end of expandable hose 112, or a similar compatible material, is sewn shut, and a rigid ring eyelet 114 is affixed. A hook 116 is mounted to one end of a support structure 90, like I-beam 92, and passes through ring eyelet 114 to hold hose 112. The same attachment method may be used at the second end of hose 112. Hose 112 may be formed from the same materials as hose 72 previously described. In other embodiments, hose 112 may be coupled to support structure 90 without employing hook 116, with the attachment being accomplished by passing a bolt or other threaded fastener through eyelet 114 and slot 97.

Although in the embodiments described above, a single length of hose 72, 112 is employed and extends along each side of I-beam 92, in other embodiments, separate lengths of hose 72, 112 may be employed, one length being disposed on each side of web 93 of I-beam 92. In such instances, I-beam 92 may have a modified end 96 at the end adjacent to a support member, and also at the unsupported, free end. Each end of each segment of hose 72, 112 may be attached to the I-beam 92 via clamps 75, as explained above with reference to FIG. 6, or the hook 116 and eyelet 114 described above with reference to FIG. 7.

Figure 8A:
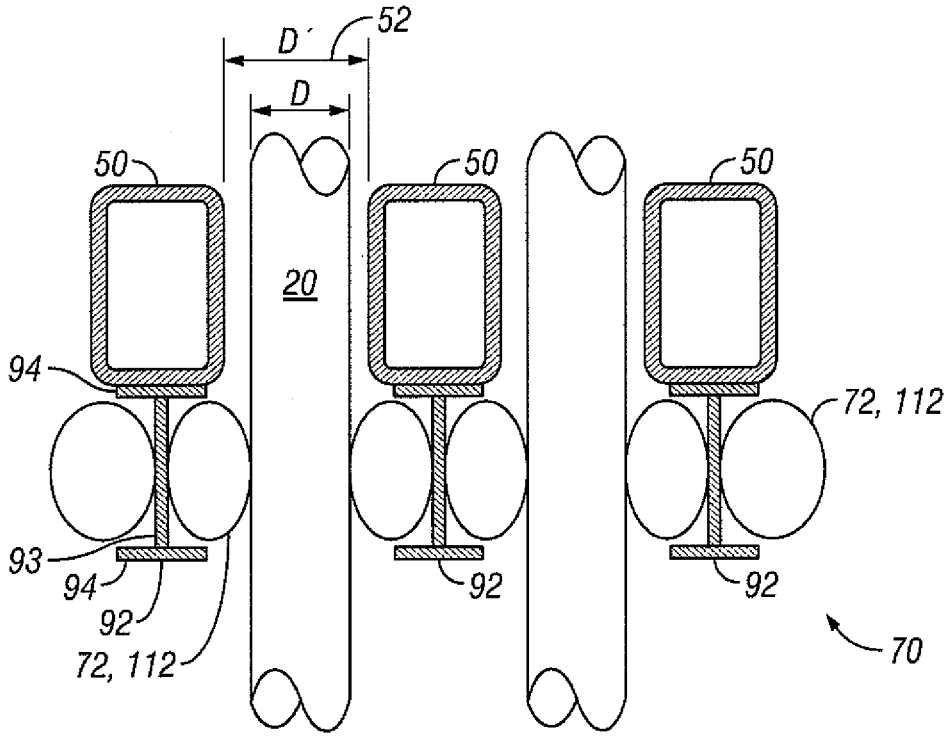
FIG. 8A is a schematic view of two fingers with inflatable restraints holding a pipe segment in accordance with the embodiment of FIG. 3.

FIG. 8A shows a schematic cross-sectional view of three inflatable restraints 70 mounted under fingers 50 attached to I-beams 92 and gripping two pipe segments 20. In this figure, hoses 72 are shown pressurized and radially expanded so as to engage pipe segments 20 to provide the desired restraint. FIG. 8A is descriptive of one or more embodiments described herein.

Figure 8B:
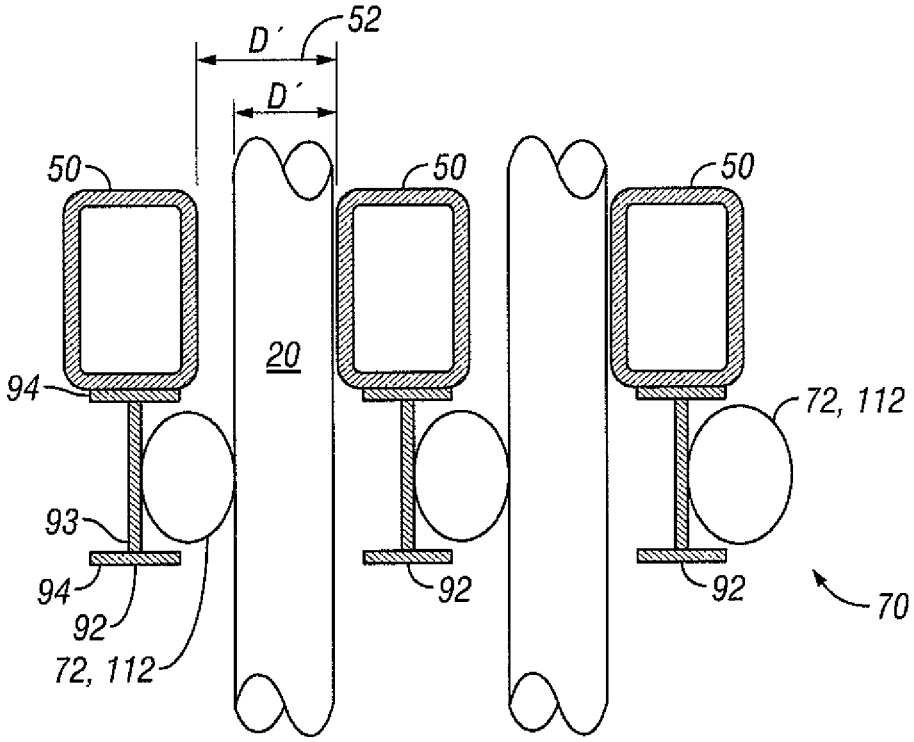
FIG. 8B is a schematic view of another embodiment of a racking board system suitable for use with the drilling system of FIG. 1, the embodiment of FIG. 8B using fewer and/or shorter inflatable restraints than the embodiment of FIG. 8A.

Referring now to FIG. 8B, there is shown another embodiment employing inflatable restraints 70 for retaining pipe segments 20. FIG. 8B shows a schematic, cross-sectional view of inflatable restraints 70 mounted under fingers 50 and attached to I-beams 92 gripping two pipe segments 20. In this embodiment, unlike the embodiment shown in FIG. 8A, an inflatable restraint 70 is disposed along only one side of slot or storage space 52. In operation, inflatable restraint 70, which may comprise hose segment 72, is pressurized and radially expands into the slot 52 so as to engage pipe segment 20 and constrain its movement by pressing it against the finger 50 located on the opposite side of slot 52 from the hose segment 72. Although not shown in FIG. 8B, the portion of finger 50 engaging pipe segment 20 may include a resilient surface, such as rubber. Alternatively, finger 50 may be structural steel without any particular coating or resilient covering. As will be understood, in comparison to the embodiment shown in FIG. 8A, the embodiment of FIG. 8B may be employed using fewer hoses 72, 112 or a shorter total length of hoses 72, 112 in inflatable restraints 70.

Figure 9A:
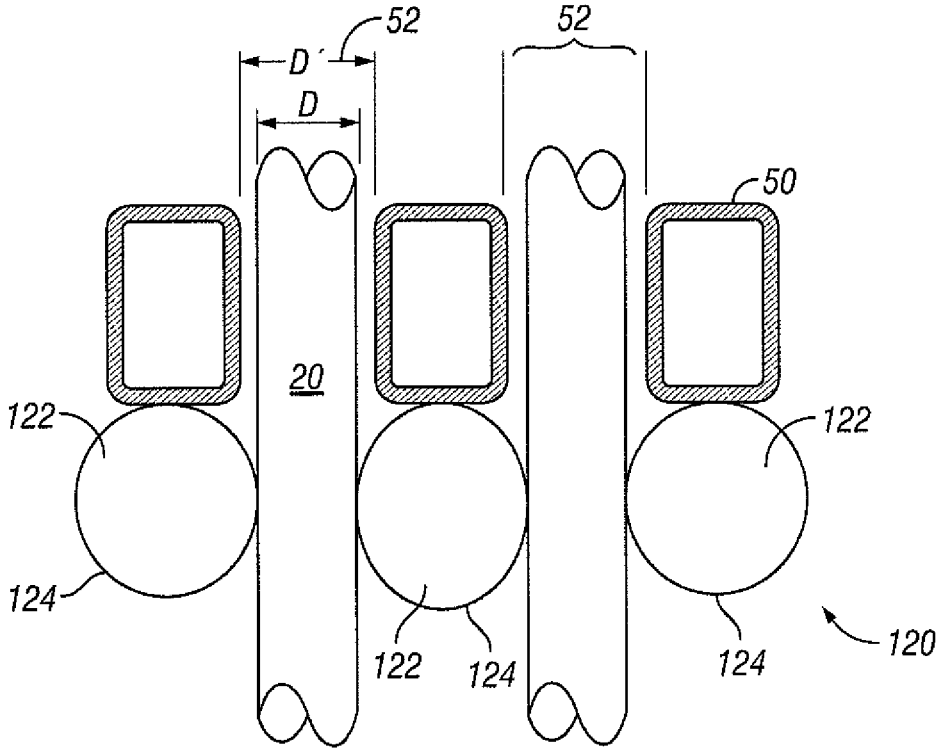
FIG. 9A is a schematic view of two fingers with inflatable restraints holding a pipe segment in accordance with at least one other embodiment.
Figure 9B:
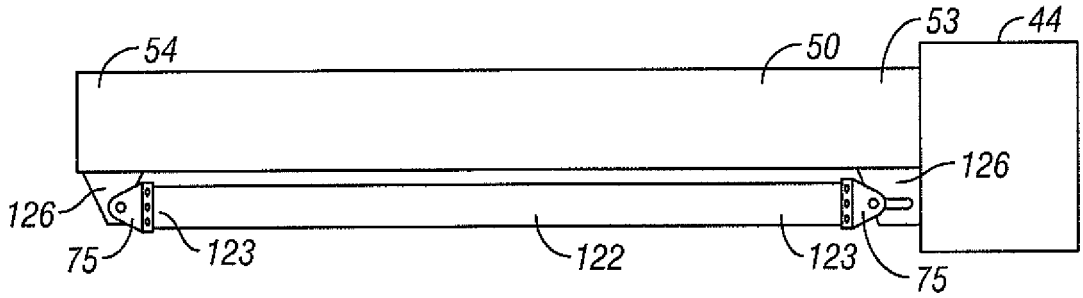
FIG. 9B is a schematic side view of a finger and an inflatable restraint of FIG. 9A.

Referring now to FIGS. 9A and 9B, yet another embodiment of an inflatable restraint 120 comprises a single radially expandable tubular member such as expandable hose 122 supported from each finger 50. Hose 122 may be formed from the same materials as hose 72 previously described. Hose 122 comprises two ends 123 and an outer surface 124. When inflated and thus expanded, a majority of outer surface 124 takes on a generally cylindrical shape. Hose 122 is disposed below each finger 50 to clamp one or more pipe segments 20 disposed on either or both sides of finger 50. Unlike hoses 72, 112 previously described, hose 122 is not supported against lateral movement by the vertical web 93 of an I-beam 92 or by a similar vertical structure extending the length of finger 50. The hose 122 extends from the vicinity of fixed end 53 to the vicinity of free end 54 of finger 50. The ends 123 of hose 112 may be sealed and held with hardware similar to clamp 75 (described with reference to FIG. 6) or may be sewn shut and held with hardware like rigid eyelet 114 and hook 116 described with reference to FIG. 7 or by another suitable method. A rigid, keel-like structure 126 similar in structure to modified end 93 of I-beam 92, may be coupled at each end 53, 54 of finger 50 to provide a support to which the ends of hose 122 are coupled. Similar mounting could be accomplished on heavy-duty fingers 55 or connection beam 45. Although hoses 122 are shown in FIGS. 9A, 9B as being supported below each finger 50, they may also be disposed above fingers 50 in a similar manner.

From the description above, it is evident that an inflatable bladder segment is located on each side of one or more gaps, i.e. storage spaces 52, that exist between adjacent fingers 50, 55. As explained, the gaps may also be formed by other combinations of parallel structures on racking board 40. In various embodiments, the bladders may include, for example, expandable hoses 72, 112, 122. The bladders are adapted for inflation and deflation. When inflated, the bladders radially-expand and extend into the adjacent storage space 52. In their expanded state, bladder segments may grip and restrain vertically-oriented elongate members, such as pipe segments 20, that are disposed in a storage space 52. Depending on the specific configuration chosen, each segment of hose 72, 112, 122, or other bladder may extend into the gap on only one side of a finger 50, 55 or may extend into the two gaps, one on each side of a finger 50, 55.

Referring to FIGS. 8 and 9A, the pipe segments 20 retained within racking board 40 have an outside diameter D. To retain pipe segments 20 between adjacent fingers 50, the storage space 52 between adjacent fingers 50 must have a dimension greater than D, this space being shown as D' in FIGS. 8 and 9A. Because of the expandable nature of inflatable hoses 72, 112, 122, pipe segments 20 or other elongate members with cross-sectional thicknesses less than D may also be retained within a storage space 52; however, the diameter D of pipe segments 20 will be limited to diameters less than D'. An exemplary system for supplying compressed gas, namely pneumatic supply system 130, is presented in FIG. 10. Pneumatic supply system 130 is configured to provide compressed gas, such as air, to the radially expandable, bladders, e.g. one or more hoses 72, 112, 122. An air supply line 132 connects to an on/off supply valve 134 to deliver air to second air line 144. Air line 144 connects to a pressure relieving regulator 138. Beyond the exit port of regulator 138, a series of interconnected gas lines 146 join regulator 138 to ports 74 on hoses 72, 112 or to similar ports on hoses 122 or on other embodiments. A pressure relieving safety valve 136 is disposed in one of the gas lines 146 and communicates with all gas lines 146 to protect the inflatable constrain system from excess pressure. Drain valves (not shown) may also be installed in communication with the hoses 72, 112, or 122 to release pressure when deactivating the inflatable restraint system. During operation, the pressure in hoses 72, 112, or 122 may rise due to the installation of pipe segments 20 in racking board 40 or may rise due to an increase in ambient temperature. The pressure relieving regulator 138 is capable of releasing excess pressure to maintain the desired or target pressure for the system.

As explained, pneumatic supply system 130 is configured to supply and maintain consistent air pressure in the radially expandable tubular members. As such, the air pressure in hoses 72, 112, or 122 may, on average, remain constant or nearly constant as pipe segments 20 are added to or removed from the storage spaces 52 on racking board 40 (FIG. 2). While hoses 72, 112, or 122 are inflated, pipe segments 20 may be installed in racking board 40 by a pipe handling system or may be racked manually by an operator. The pressure that is applied to pipe segments 20 by hoses 72, 112, 122 constrain and retain the end of pipe segments 20 in racking board 40. However, it is to be understood that the pressure supplied by the inflated hoses 72, 112, 122 is not so great as to prevent movement of the pipe segment 20 into or out of a storage space 52. In other words, to rack pipe segments 20 in a slot or storage space 52, it is not necessary to deflate the hoses 72, 112, 122. Likewise, a pipe segment 20 may be removed from a slot 52 without deflating the hoses. Instead, in normal operation, it is intended that the hoses remain inflated as the pipe segments 20 are placed into or removed from slotted storage spaces 52. Nevertheless, the system may alternatively be operated with hoses 72, 112, 122 unpressurized and in their relaxed, unexpanded configurations. In this manner, racking board 40 would operate as a conventional racking board, and other means, such as ropes, would be required in order to restrain the ends of pipe segments 20. Air supply and pressure regulation for inflatable restraint 70 and other embodiments may be achieved using other pneumatic supply systems and other hardware known in the art while still falling within the scope of this disclosure. Another compatible compressed gas, such as nitrogen, may be used in place of compressed (pressurized) air.

In some embodiments, pneumatic supply system 130 may provide compressed air with a gauge pressure up to 110 pounds per square inch (psig) in supply line 132. Pressure relieving regulator 138 may be set to provide pressurized air at 10 to 20 psig to hoses 72, 112, or 122. Pressure relieving safety valve 136 may be set to release at a pressure near 30 psig. For example, a pressure of 15 psig may be employed as the set point for pressure relieving regulator 138.

One or more of the embodiments of an inflatable restraint system described above may be used on a single racking board 40 (FIG. 2). For example some fingers 50, heavy duty fingers 55, or portions of connecting beam 45 may have an embodiment of inflatable restraint 70 installed, while other locations simultaneously may have inflatable restraint 120 installed.

While certain embodiments have been described, modifications thereof can be made by one skilled in the art without departing from the teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Those skilled in the art will also appreciate that the disclosed systems and techniques are not limited to any particular type of operation or environment (e.g., embodiments of the inflatable systems described herein can also be used for the retention of non-tubular members). Further, the various embodiments of the invention may be implemented for use on land or offshore, such as on offshore oil rigs. All such implementations of the systems and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A racking board for restraining one or more rigid, elongate tubular members, said racking board comprising:

a first horizontally-extending elongate finger having a longitudinal axis;

a second horizontally-extending elongate finger having a longitudinal axis oriented parallel to said longitudinal axis of said first finger and horizontally spaced from said first elongate finger by a gap, wherein said gap has a width greater than a diameter of at least one of said rigid, elongate tubular members; and a first elongate support member mounted to said first finger and extending axially along said first finger; said first support member having a first end, a second end opposite said first end of said first support member, a central web portion extending vertically from said first finger, and a flange extending from said web portion and positioned distal said first finger; and a first inflatable member having a first end coupled to said first end of said first support member on a first side of said first support member and a second end coupled to said first end of said first support member on a second side of said first support member, wherein said first inflatable member wraps around said second end of said first support member;

wherein the first support member includes a first recess on said first side of said first support member between said flange and said first finger and a second recess on said second side of said first support member between said flange and said first finger;

wherein said first inflatable member is disposed within said first recess adjacent said gap and is configured to expand horizontally into said gap when inflated; and wherein said first inflatable member is disposed within said second recess.

2. The racking board of claim 1 further comprising:

a second elongate support member mounted to said second finger and extending axially along said second finger, said second support member having a first end and a second end opposite said first end of said second support member; and a second inflatable member having a first end coupled to said first end of said second support member on a first side of said second support member and a second end coupled to said first end of said second support member on a second side of said second support member, wherein said second inflatable tubular member wraps around said second end of said second support member;

wherein said second inflatable member is disposed adjacent said gap and is configured to expand into said gap when inflated.

3. The racking board of claim 2, wherein said first and second inflatable members each comprise a tubular segment configured to expand radially when inflated.

4. The racking board of claim 2, wherein said first and second inflatable members each comprise an elongate inflatable bladder.

5. The racking board of claim 4, wherein said bladders comprise an externally-reinforced hose having a rubber lining.

6. The racking board of claim 2, further comprising:

a vertically-extending support structure for supporting a drill string within a well bore;

wherein said racking board is supported by said vertically-extending structure;

wherein said first and second inflatable members are configured to be independently expandable from a first volume to a second volume and extending into said gap when inflated to said second volume.

7. The racking board of claim 6, wherein said first and second inflatable members each comprise a hose segment that is adapted to expand radially upon inflation.

8. The racking board of claim 6, wherein said racking board comprises:

a pair of arms coupled to said vertically-extending support structure;

a plurality of horizontally-extending elongate fingers extending from each of said arms with a gap defined between each pair of adjacent fingers of said plurality;

an elongate support member mounted to and extending along each of said fingers;

a plurality of inflatable members, each inflatable member supported along a side of each of two adjacent gaps; and a gas supply system for inflating said inflatable members and causing them to radially expand.

9. The apparatus of claim 1 wherein said first and second ends of said first inflatable member are adjustably coupled to said first end of said first support member and are configured to be adjustably moved in a direction parallel to said longitudinal axis of said first finger.

10. Apparatus for restraining a plurality of vertically-oriented, elongate members, said apparatus comprising:

a vertical support structure configured to support a drill string suspended within a borehole;

an arm coupled to said support structure and extending generally horizontally from said support structure;

a plurality of parallel fingers extending generally horizontally from said arm, wherein each finger has a longitudinal axis, and wherein a gap is disposed between each pair of adjacent fingers; and a plurality of elongate inflatable members, wherein each inflatable member is positioned adjacent one of said fingers, wherein each inflatable member has a first end axially adjustably coupled to said corresponding finger and a second end coupled to said corresponding finger, wherein the first end of each inflatable member is configured to be adjustably moved in a direction parallel to said longitudinal axis of said corresponding finger;

wherein said inflatable members are adapted to expand and extend into said gaps when inflated.

11. The apparatus of claim 10 wherein said inflatable members comprise tubular portions adapted for inflation with gas.

12. The apparatus of claim 11 further comprising a gas supply system adapted to inflate said inflatable members, thereby causing them to radially expand.

13. The apparatus of claim 12 wherein said gas supply system comprises a pressure relieving regulator configured to maintain a target pressure within said gas supply system and to relieve pressure in excess of said target pressure.

14. The apparatus of claim 11 wherein a first and a second of said inflatable members are coupled to at least some of said fingers, said first inflatable member adapted to expand into a first gap, and said second inflatable member adapted to expand into a second gap.

15. That apparatus of claim 11 wherein a single inflatable member is coupled to a first finger and is adapted to expand into a first gap on one side of said first finger and into a second gap on the other side of said first finger.

16. The apparatus of claim 11 wherein a pair of said tubular portions is coupled to at least one of said plurality of fingers.

17. The apparatus of claim 11 wherein one of said tubular portions is adapted to expand into two gaps upon inflation with gas.

18. The apparatus of claim 10 wherein said inflatable members comprise hose segments adapted to expand radially when inflated.

19. The apparatus of claim 18 wherein at least one of said hose segments is disposed on each side of said gap.

20. The apparatus of claim 18 wherein said inflatable members comprise an externally-reinforced hose having an interior lining adapted to hermetically seal said hose.

21. The apparatus of claim 10 further comprising a pneumatically actuatable latch member disposed adjacent said end of at least one finger and adapted to move between a first position in which it blocks a gap and prevents a tubular from being moved into or out of said gap, to a second position in which it does not block said gap, said latch member including a spring return adapted to cause said latch member to move to said first position upon loss of air pressure.

22. The apparatus of claim 10 further comprising a plurality of elongate support members having a first end with a slot and a second end opposite said first end, said elongate support members coupled adjacent said fingers and extending alongside said fingers;

a plurality of attachment members, each coupled to said first end of one of said inflatable members;

wherein said plurality of attachment members adjustably engage said slots in said support members and are configured to be adjustably moved in a direction parallel to said longitudinal axis.

23. A method of restraining tubular members comprising;

supporting a plurality of spaced-apart parallel elongate fingers at a height above a drill floor, said fingers arranged in pairs with a gap between each pair of fingers;

supporting an elongate, expandable member adjacent at least one side of at least one gap, said expandable member configured to expand radially into said gap upon inflation;

expanding said expandable member into said gap;

slidingly engaging a tubular member disposed in said gap with said expanded expandable member;

restraining said tubular member from moving relative to said fingers with said expanded expandable member;

removing said tubular member from said gap while the expandable member is expanded.

24. The method of claim 23 further comprising slidingly engaging said expanded expandable member with a tubular member while inserting said tubular member into said gap.

25. The method of claim 23 further comprising: maintaining a target pressure within said expanded expandable member after said step of slidingly engaging said expanded expandable member with a tubular member.

* * * * *